US011079114B2

(12) United States Patent
Barry

(10) Patent No.: US 11,079,114 B2
(45) Date of Patent: Aug. 3, 2021

(54) PLATE STEEL SINGLE BURN RATE WOOD HEATER WITH IMPROVED EMISSIONS

(71) Applicant: United States Stove Company, South Pittsburg, TN (US)

(72) Inventor: Brandon Lane Barry, Sewanee, TN (US)

(73) Assignee: United States Stove Company, South Pittsburg, TN (US)

( * ) Notice: Subject to any disclaimer, the term of this patent is extended or adjusted under 35 U.S.C. 154(b) by 509 days.

(21) Appl. No.: 15/815,698

(22) Filed: Nov. 16, 2017

(65) Prior Publication Data

US 2018/0135860 A1 May 17, 2018

Related U.S. Application Data

(60) Provisional application No. 62/422,742, filed on Nov. 16, 2016.

(51) Int. Cl.
*F24B 5/02* (2006.01)
*F24B 1/02* (2006.01)
*F24B 7/02* (2006.01)

(52) U.S. Cl.
CPC ..... *F24B 5/026* (2013.01); *F24B 1/028* (2013.01); *F24B 7/025* (2013.01)

(58) Field of Classification Search
CPC ..... F24B 5/026; F24B 1/028; F24B 7/025
USPC ..... 126/77, 500–555, 88
See application file for complete search history.

(56) References Cited

U.S. PATENT DOCUMENTS 4,267,817 A * 5/1981 Hicks ..... F24B 5/026 126/60
4,941,451 A * 7/1990 Gilham ..... F24B 5/026 126/112
2003/0111071 A1* 6/2003 Perrault ..... F24B 5/026 126/77
2014/0315137 A1* 10/2014 Pedersen ..... F23L 3/00 431/12

* cited by examiner

*Primary Examiner* — Vivek K Shirsat
(74) *Attorney, Agent, or Firm* — Pitchford Fugett, PLLC; Mark A. Pitchford; Eric B. Fugett

(57) ABSTRACT

A single burn rate woodstove provides primary combustion air and secondary combustion air to a combustion chamber of the woodstove. The woodstove includes a primary air inlet, a primary air outlet into the combustion chamber, and a secondary air outlet into the combustion chamber. Some embodiments of the inventions include secondary air inlet(s) for the secondary combustion air separate from the primary air inlet. Some embodiments of the invention include the same firebox sizes as known in the prior art while providing such inexpensive single burn rate woodstoves with improved emissions performance by using both primary and secondary combustion air.

19 Claims, 18 Drawing Sheets

SECTION A-A

SECTION B-B

SECTION A-A

SECTION E-E

SECTION D-D

SECTION G-G

SECTION F-F

SECTION E-E

PLATE STEEL SINGLE BURN RATE WOOD HEATER WITH IMPROVED EMISSIONS

CROSS-REFERENCES TO RELATED APPLICATIONS

This application claims priority to and hereby incorporates by reference in its entirety U.S. Provisional Patent Application No. 62/422,742 entitled "PLATE STEEL SINGLE BURN RATE WOOD HEATER WITH IMPROVED EMISSIONS" filed on Nov. 16, 2016.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to utility class woodstoves. More particularly, this invention pertains to utility class woodstoves with reduced particulate matter output.

Utility class woodstoves are constructed of welded plate steel assemblies and are designed to burn wood at relatively high burn rates. These high burn rate utility stoves were exempt from Environmental Protection Agency (EPA) regulations that were in place from February of 1988 until March of 2015 (40 CFR 60 Subpart AAA: Standards of Performance for New Residential Wood Heaters) because their burn rates exceeded 5 kg/hr. EPA regulations promulgated in March of 2015 began to regulate these devices and thus there was a need for a cleaner burning version of this class of high burn rate utility woodstove heater. Under this new EPA regulation this type of heater is referred to as a single burn rate heater or woodstove. Single burn rate woodstoves are designed to operate at a single combustion rate that optimizes fuel efficiency and reduces overall particulate matter (PM) emissions output. In order to minimize costs, they have fixed combustion air opening sizes such that the flow rate of the incoming combustion air stream introduced to the woodstove is not adjustable. The heat output of these appliances is simply regulated by the size (i.e., mass) of the wood load that the user adds to the combustion chamber or firebox at any given time.

BRIEF SUMMARY OF THE INVENTION

Aspects of the present invention are directed to a utility class single burn rate woodstove with reduced particulate matter emissions. More particularly, aspects of the invention provide a single burn rate woodstove with both primary combustion air and secondary combustion air.

Aspects of the invention include a single burn rate woodstove providing primary combustion air and secondary combustion air to a combustion chamber of the woodstove. The woodstove includes a primary air inlet, a primary air outlet into the combustion chamber, and a secondary air outlet into the combustion chamber. Some embodiments of the inventions include secondary air inlet(s) for the secondary combustion air separate from the primary air inlet. Some embodiments of the invention include the same firebox sizes as known in the prior art while providing such inexpensive single burn rate woodstoves with improved emissions performance by using both primary and secondary combustion air.

In another aspect, a single burn rate woodstove includes a primary air inlet, a secondary air inlet, a secondary air channel, and a primary air channel. The primary air inlet is through a front of a main body of the woodstove at a top of the main body of the woodstove. The secondary air inlet is through the main body of the woodstove. The secondary air channel is configured to receive secondary air from the secondary air inlet and conducts the received secondary air to a secondary air orifice at a top and a front of a combustion chamber of the woodstove. The primary air channels configured to transfer primary combustion air from the primary air inlet to below the secondary air orifice for introduction into the combustion chamber at the front of the combustion chamber.

In another aspect, a single burn rate woodstove includes a combustion air inlet and a combustion air manifold. The combustion air inlet is through the door of the woodstove and a front of the woodstove. The combustion air manifold is configured to receive combustion air from the combustion air inlet and provide primary and secondary combustion air to a combustion chamber of the woodstove. The combustion air manifold is attached to the door and a back of the door. The primary combustion air outlet is formed at a bottom of the combustion air manifold such that the primary combustion air outlet provides primary combustion air to the combustion chamber from the combustion air manifold. The secondary combustion air outlet is formed at a top of the combustion air manifold such that the secondary combustion air outlet provides secondary combustion air to the combustion air chamber from the combustion air manifold at a top of the combustion chamber.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
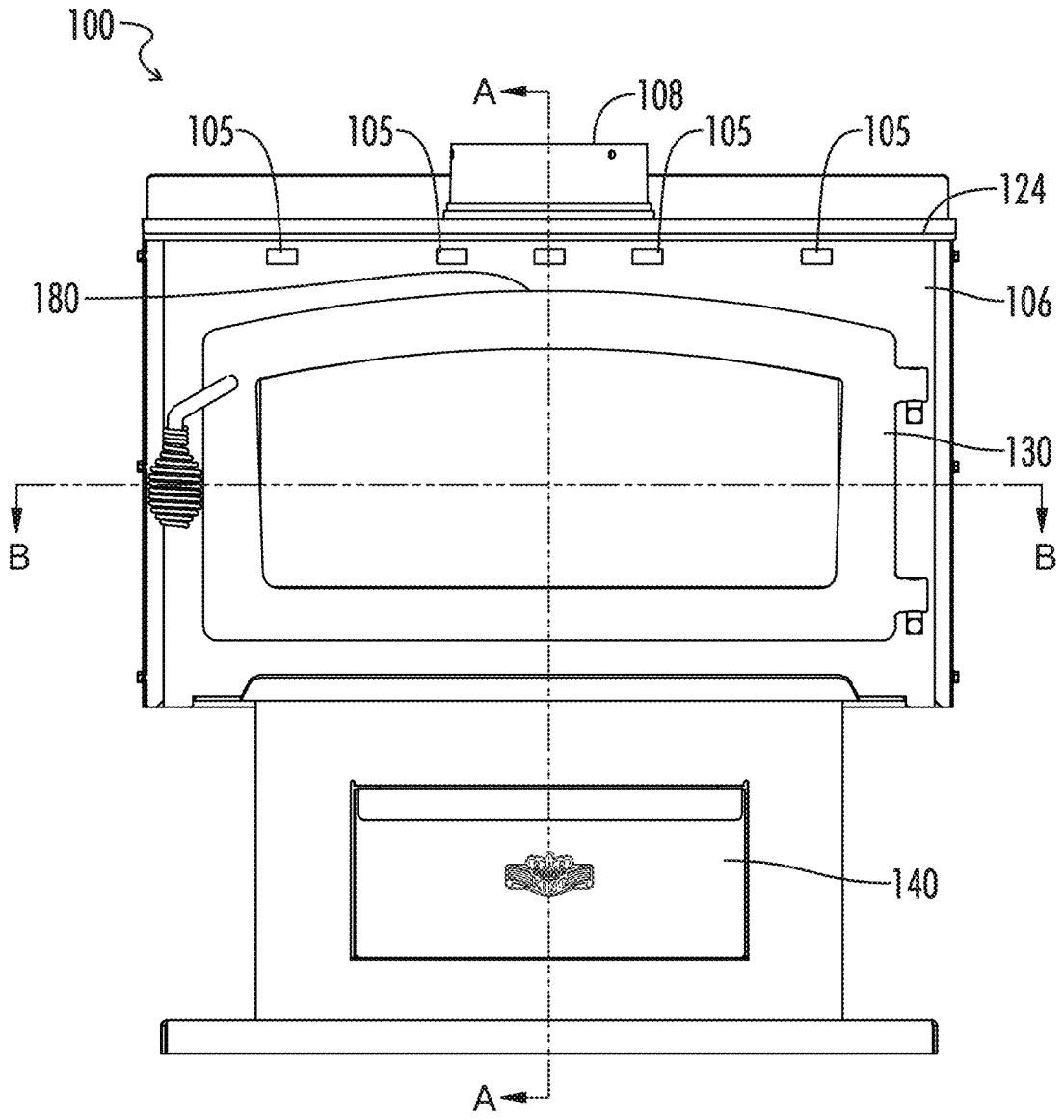
FIG. 1 is a front view of a single burn rate woodstove according to one embodiment of the invention.
Figure 2:
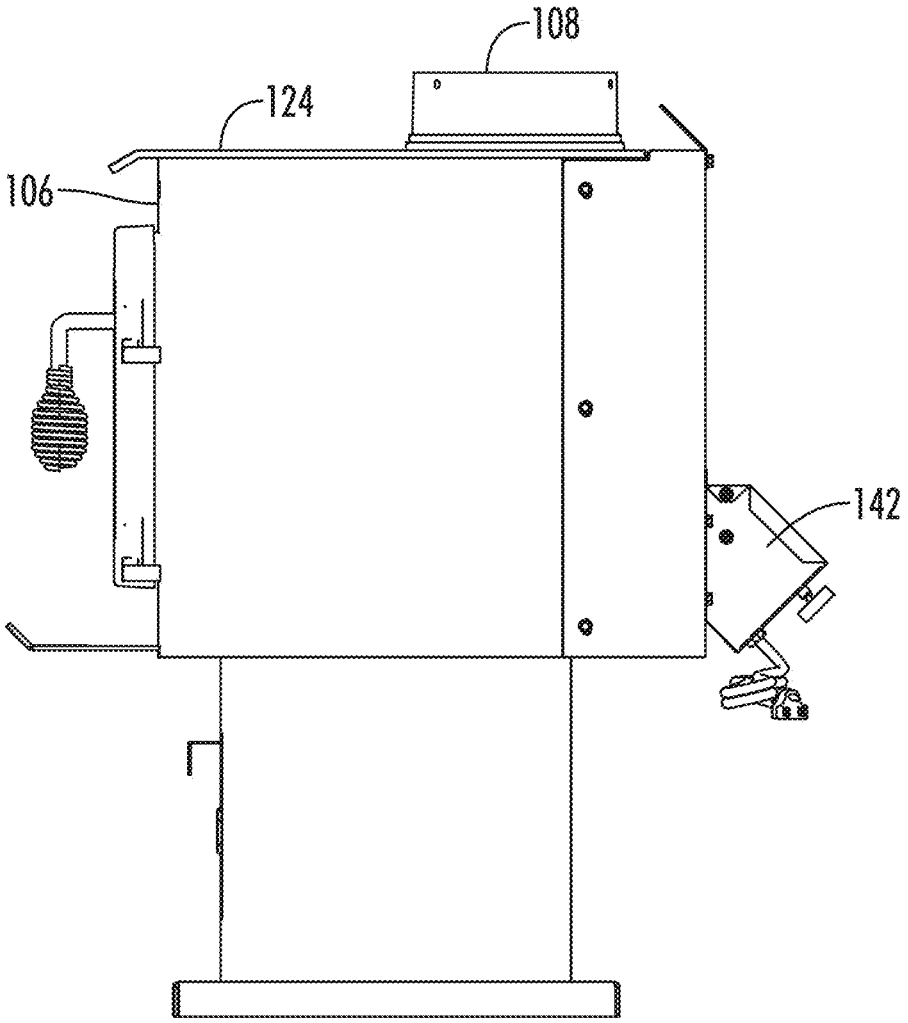
FIG. 2 is a side view of the woodstove of FIG. 1.
Figure 3:
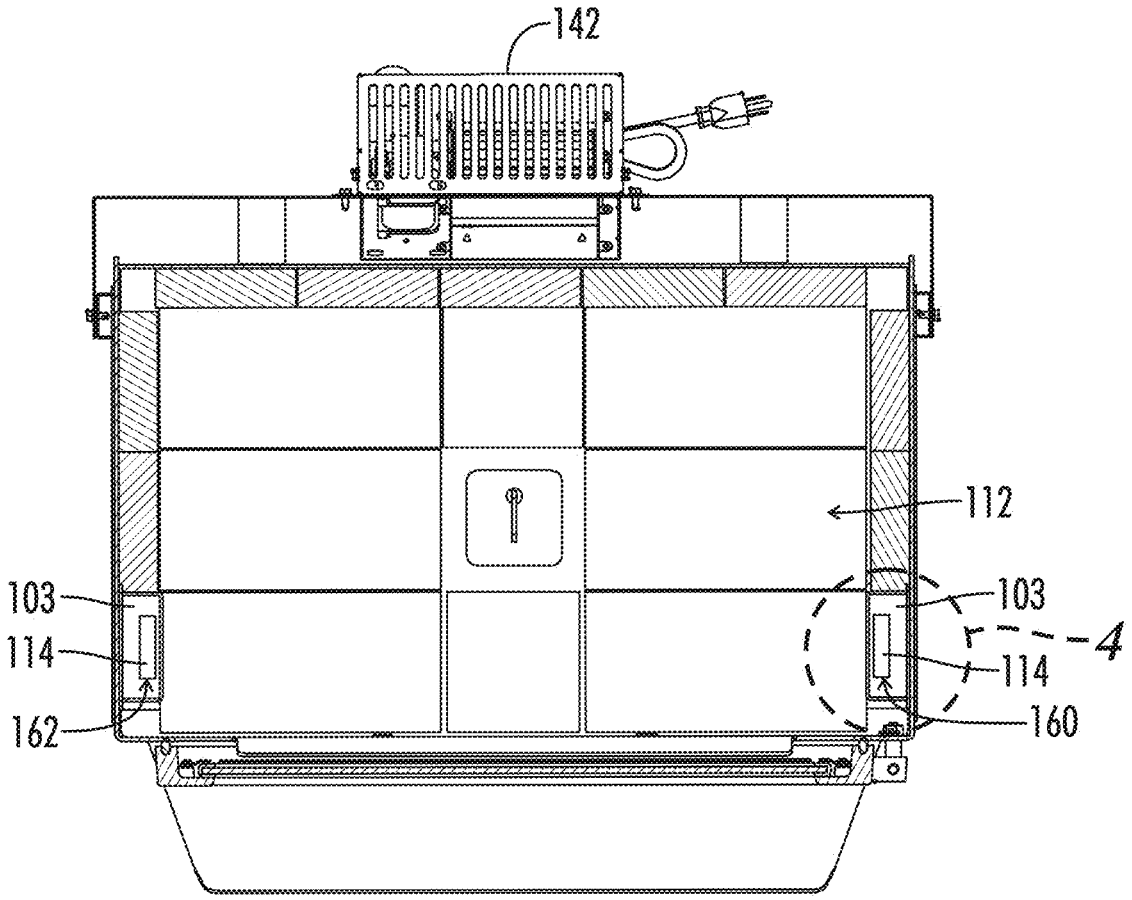
FIG. 3 is a top cutaway view of the woodstove of FIG. 1 taken across the plane marked B in FIG. 1.
Figure 4:
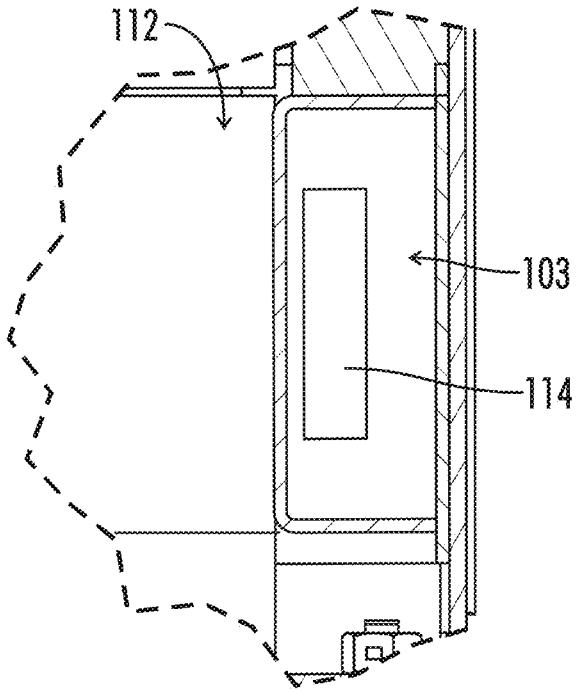
FIG. 4 is a detailed view of the secondary air intake marked in the woodstove of FIG. 3.
Figure 5:
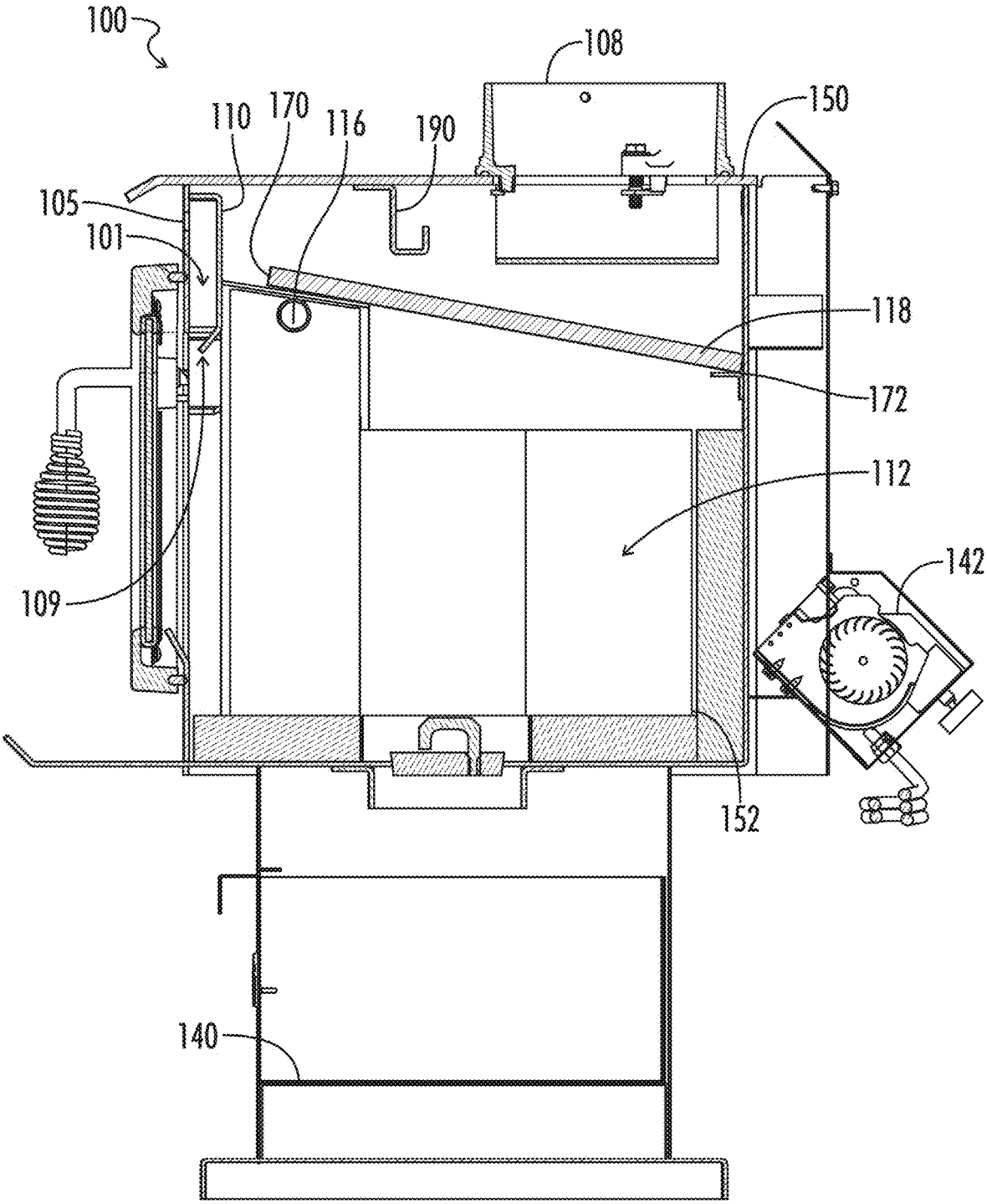
FIG. 5 is a side cutaway view of the woodstove of FIG. 1 taken along the plane marked A.
Figure 6:
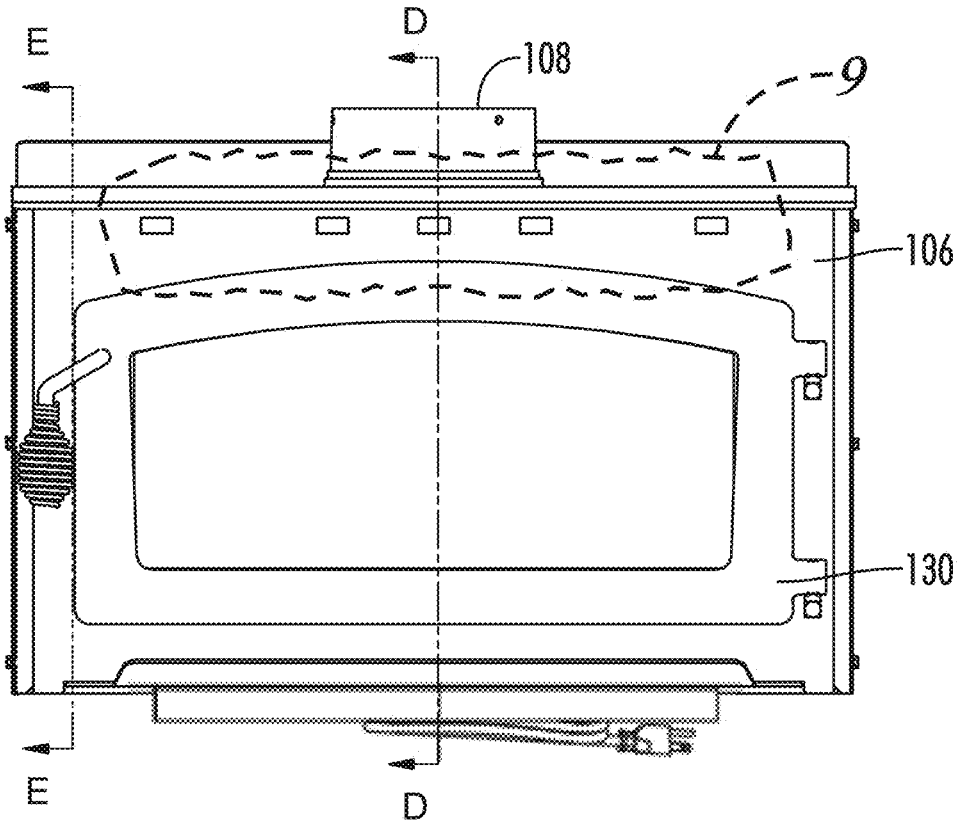
FIG. 6 is a detailed front view of an upper portion of the woodstove of FIG. 1 including a combustion chamber of the woodstove.
Figure 7:
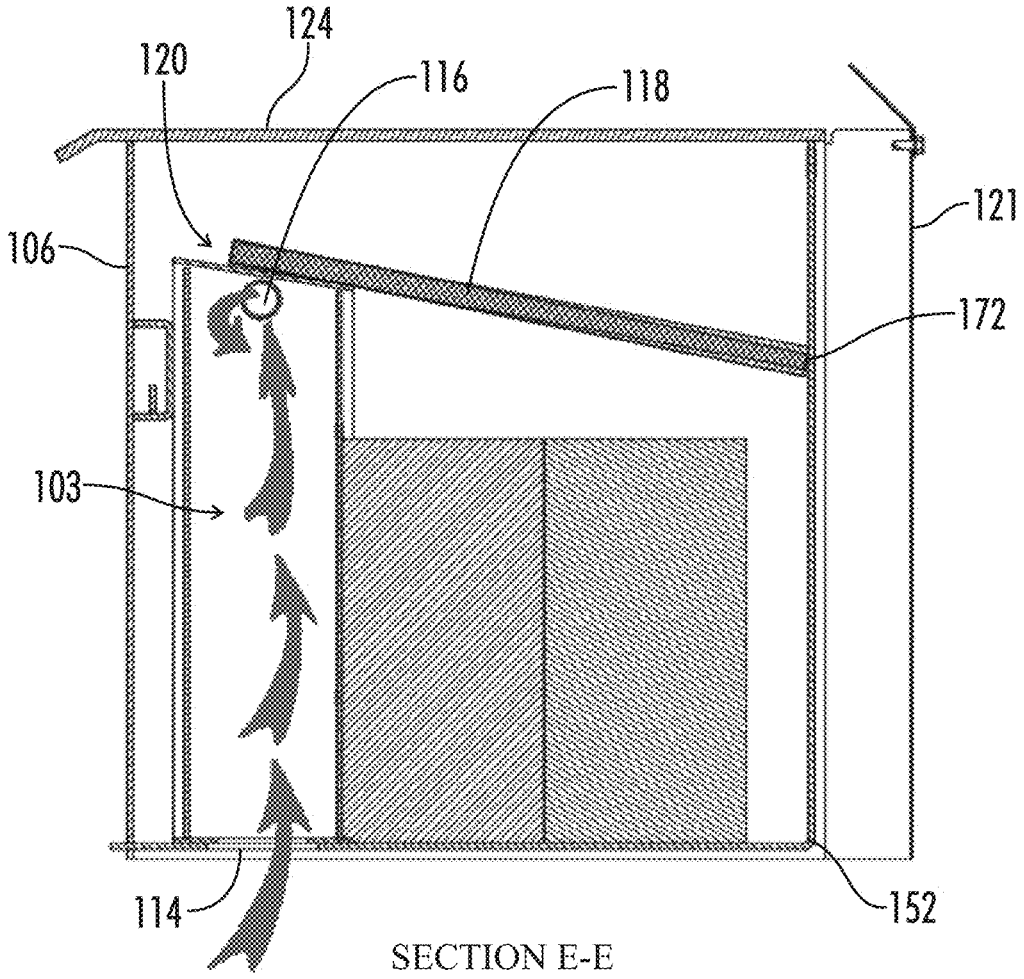
FIG. 7 is a cutaway view of the woodstove of FIG. 6 taken along the plane marked E showing secondary air taken into the combustion chamber.
Figure 8:
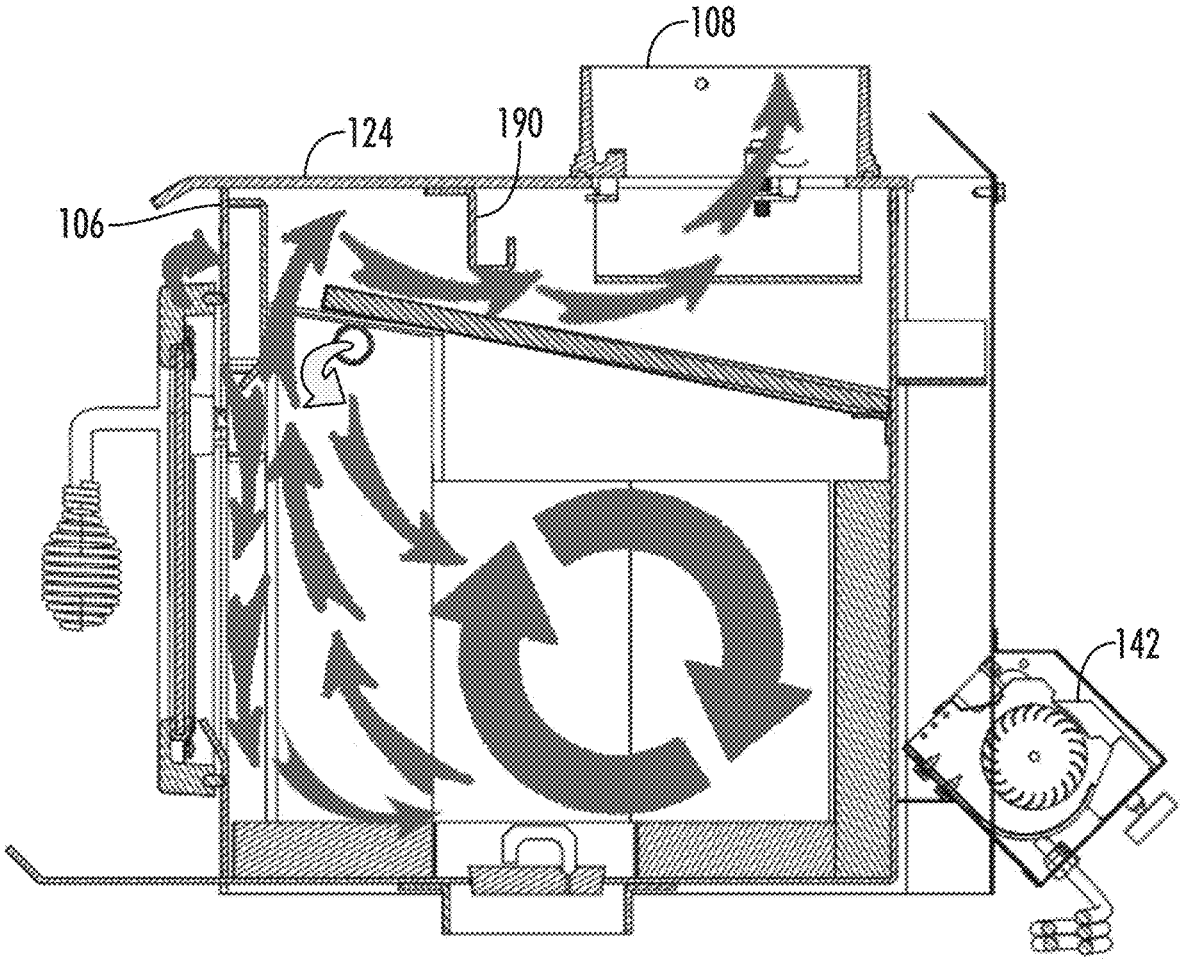
FIG. 8 is a cutaway view of the woodstove of FIG. 6 taken along the plane marked D showing primary air entering the combustion chamber and exhaust gases exiting the combustion chamber through a flue of the woodstove.
Figure 9:
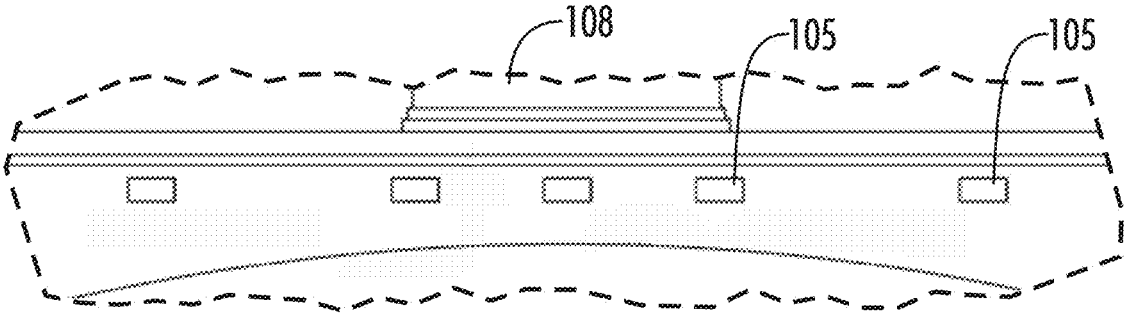
FIG. 9 is a detailed view of a primary air intake of the woodstove of FIG. 6.
Figure 10:
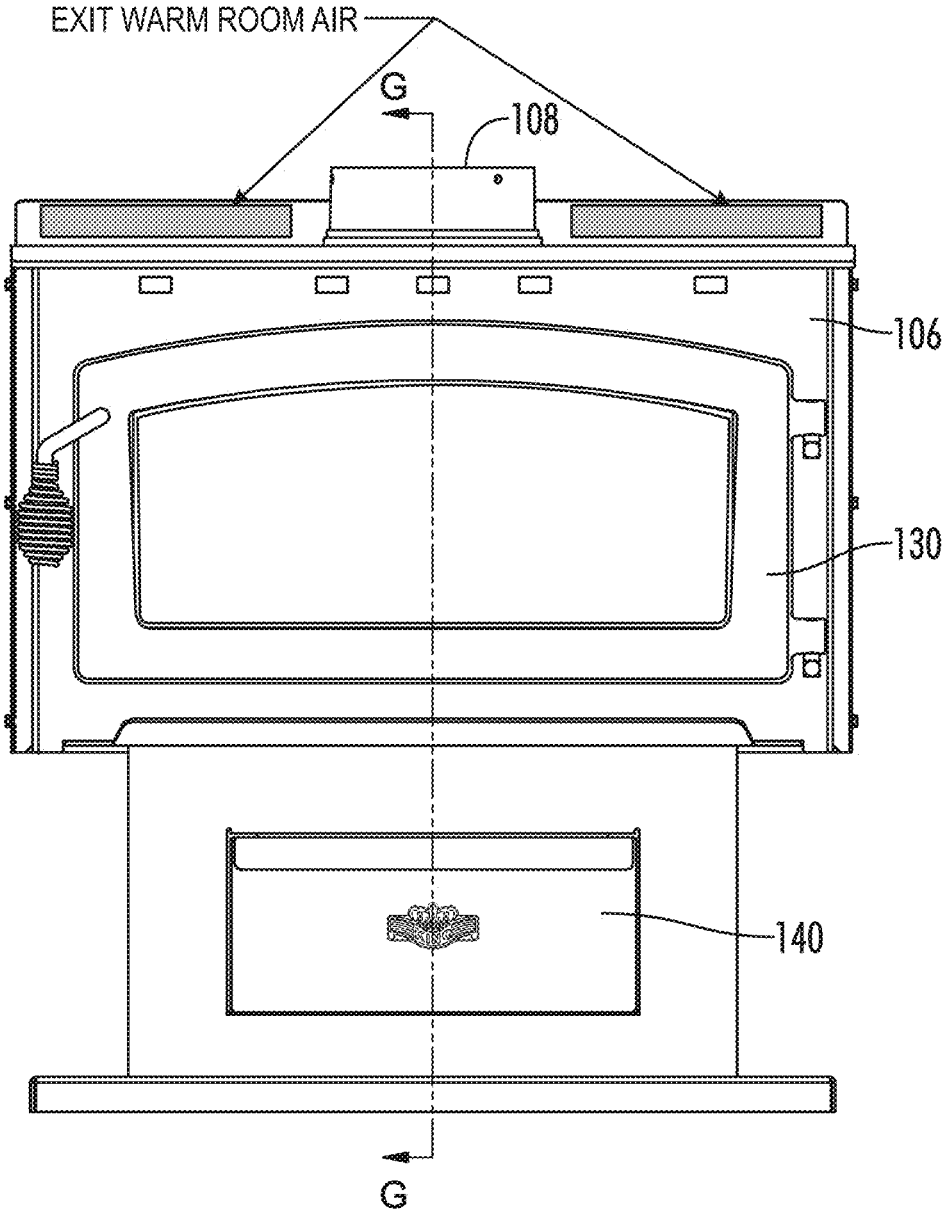
FIG. 10 is a front view of the woodstove of FIG. 1 showing warmed room air exiting the woodstove toward a front of the woodstove.
Figure 11:
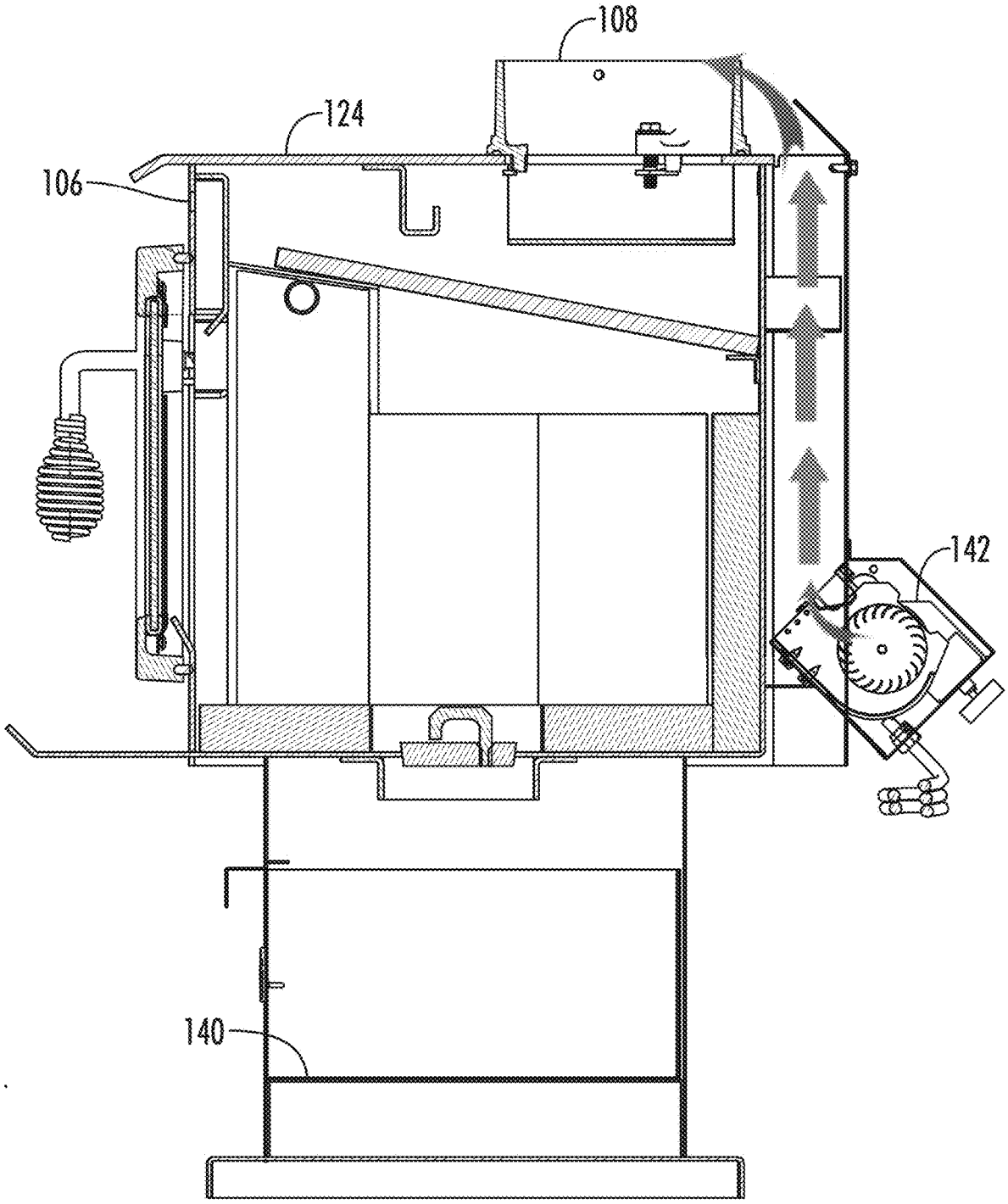
FIG. 11 is a side cutaway view of the woodstove of FIG. 10 taken along the plane marked G showing a circulation fan of the woodstove moving room air across the woodstove to generated the warmed room air exiting the front of the woodstove as shown in FIG. 10.
Figure 12:
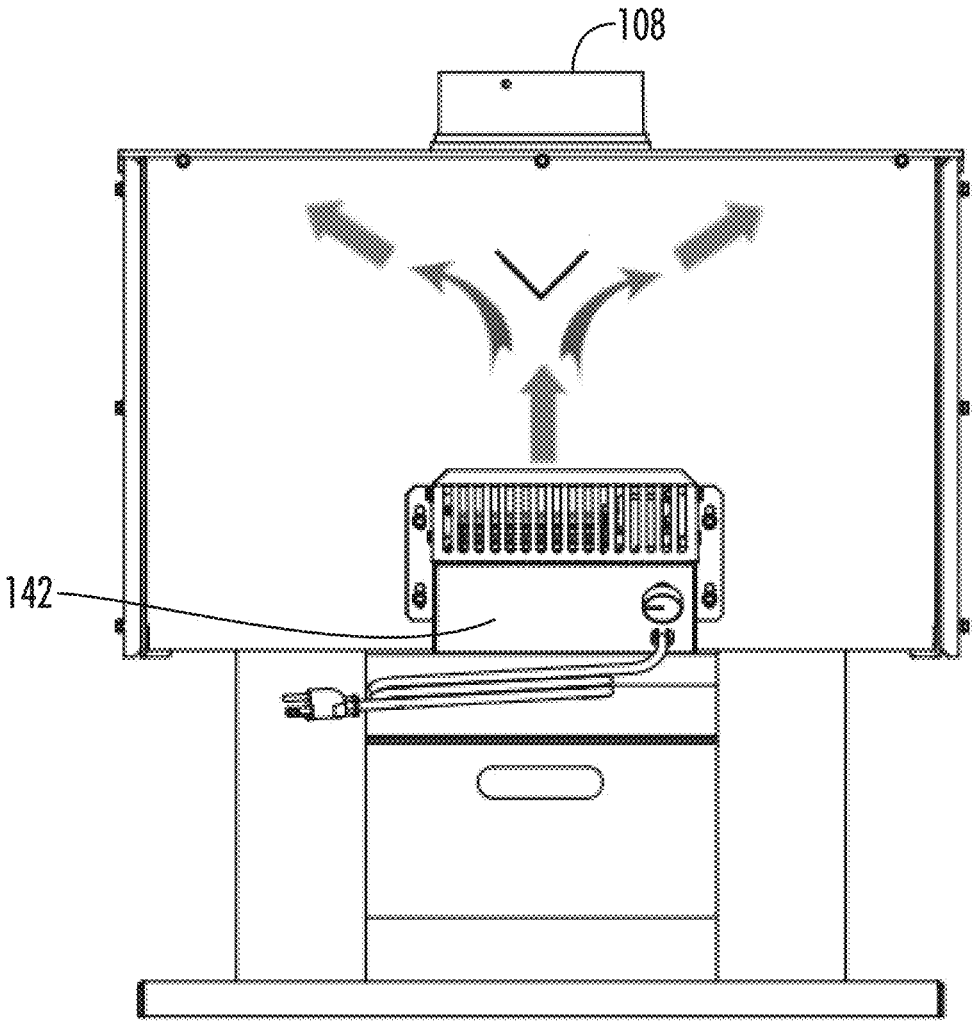
FIG. 12 is a rear cutaway view of the woodstove of FIG. 10 removing a rear panel of the woodstove to show a room air deflector spreading forced room air across the woodstove.
Figure 13:
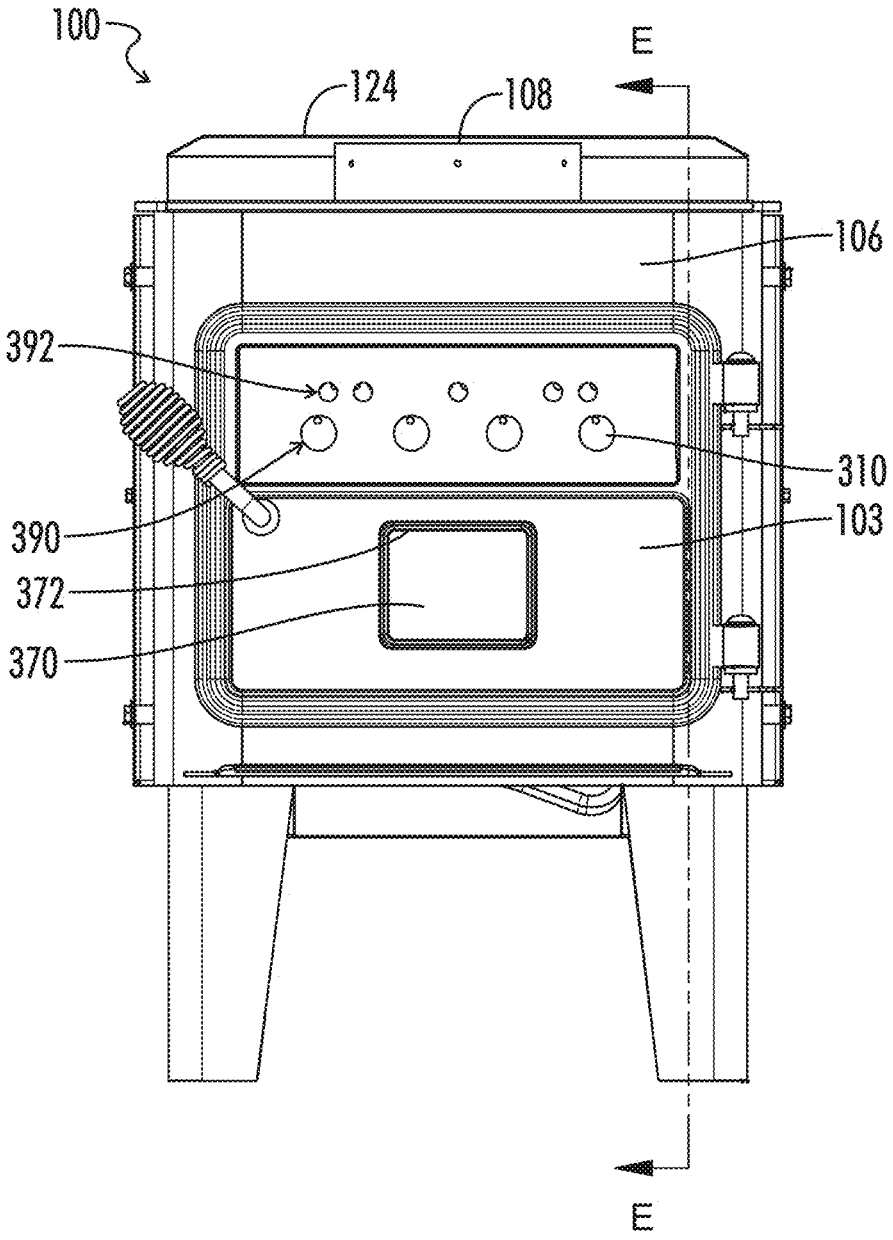
FIG. 13 is a front view of a woodstove according to one embodiment of the invention.
Figure 14:
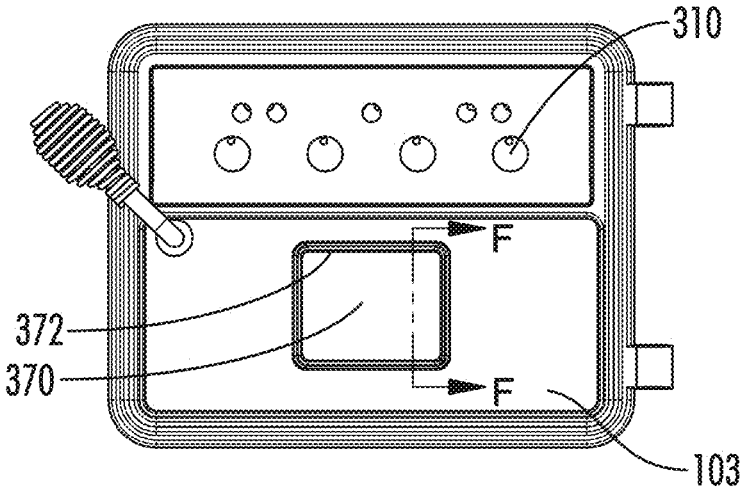
FIG. 14 is a front detail view of a door of the woodstove of FIG. 13.
Figure 15:
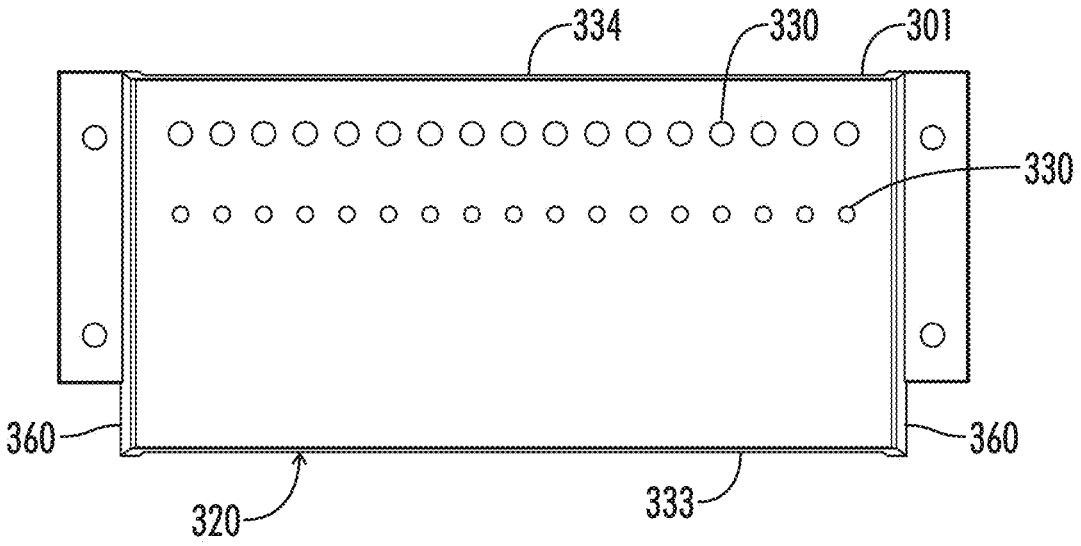
FIG. 15 is a rear view of a primary and secondary air baffle of the door of FIG. 14.
Figure 16:
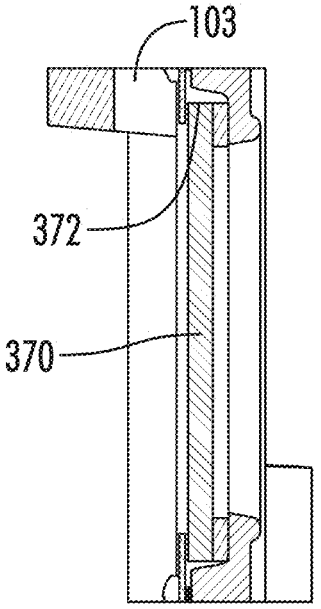
FIG. 16 is a cross sectional view of the woodstove of FIG. 13 taken along the plane marked F.
Figure 17:
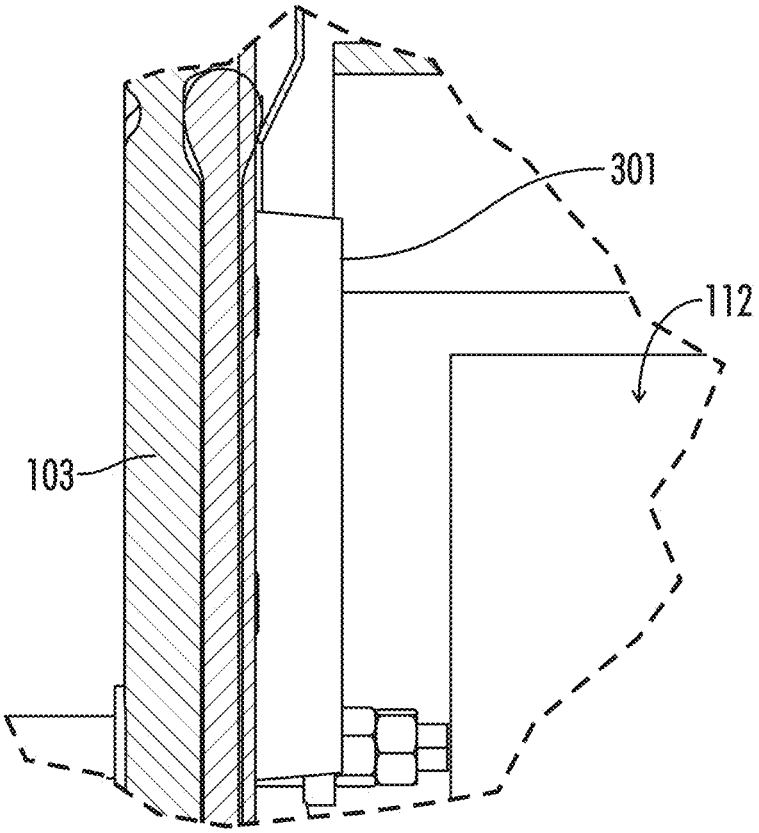
FIG. 17 is a side detail view of the front door of the woodstove of FIG. 13 showing the primary and secondary air baffle.
Figure 18:
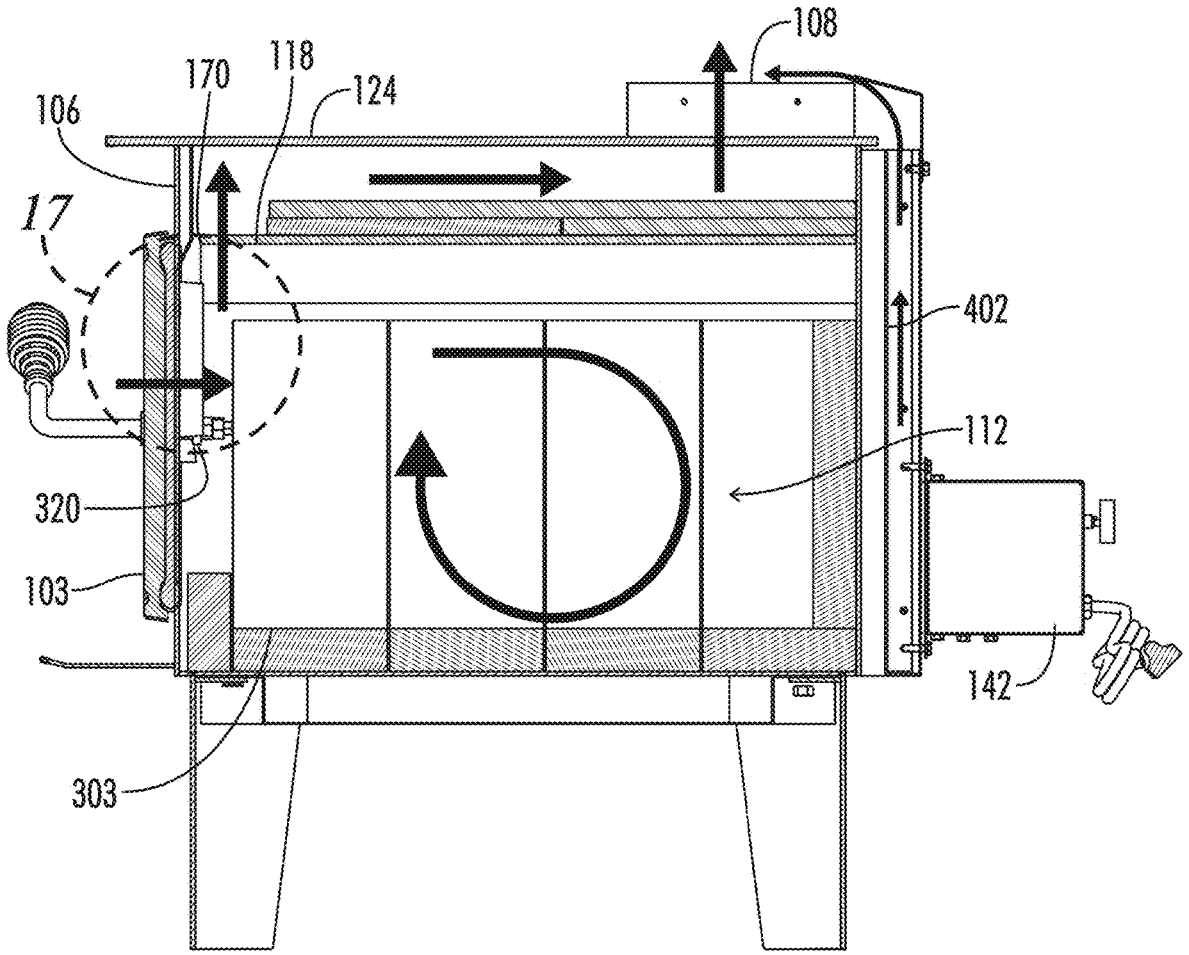
FIG. 18 is a cutaway view of the woodstove of FIG. 13 taken along the plane marked E showing the flow of primary air, secondary air, exhaust gases, and room air through the woodstove.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component. The upright position disclosed herein is where the woodstove or appliance is installed for proper operation as shown in, for example, FIGS. 1 and 13.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Referring to FIGS. 1-12, in one embodiment of a single burn rate plate steel woodstove 100, combustion air is introduced through two channels: a primary air channel 101 and a secondary air channel 103. This primary and secondary combustion air is pulled into the stove (i.e., woodstove 100) through natural draft established by the chimney (i.e., flue) 108 connected to the heater (i.e., woodstove 100). Primary combustion air enters through a primary air intake or inlet 105 in a front 106 of the woodstove 100 and travels into the primary air channel 101 where the primary combustion air is distributed through an opening 109 at the bottom of the primary air channel 101 (i.e., at or near the front and bottom of the firebox or combustion chamber 112). This air is the primary combustion air source that feeds the fire in the firebox (i.e., combustion chamber 112).

Secondary air (i.e., secondary combustion air) is drawn in through a secondary air inlet 114 on the bottom of the stove 100 at the front 106. This air then travels into two secondary air manifolds 116 extending between the two opposing secondary air channels 103. A series of orifices in each manifold tube 116 introduces the secondary combustion air into the firebox 112 below a top baffle 118 which forms the top of the firebox or combustion chamber 112. The top baffle 118 makes the secondary air mix with the hot gasses produced by the fire in the firebox 112 and burns off excess particulate emissions (i.e., smoke) generated from said fire. That is, the preheated secondary air causes particulate in the smoke stream (i.e., exhaust air or gas) to burn as the exhaust gases rise to exit the combustion chamber 112 through a gap 120 between the top baffle 118 and the front 106 of the stove 100. A ceramic fiber blanket insulates the top baffle 118 and serves to increase the temperature in the firebox 112 as these processes occur. After the secondary air has reacted with the hot gasses in the firebox, the exhaust gases turn above the top baffle 118 at the front 106 of the stove 100 and move toward the rear 121 of the stove 100, losing heat to a top surface 124 of the stove 100. The exhaust gases then exit the heater 100 through the flue outlet 108 in the top of the stove 100 near the rear 121 of the stove 100. This combination of changes provides a new version of a single burn rate woodstove heater that achieves improved emissions levels that are compliant with the new EPA regulations, as well as increased efficiency while still maintaining the simplistic, inexpensive, and low maintenance nature of the single burn rate woodstove 100. In one embodiment, the woodstove 100 has a main body forming the combustion chamber, and the main body includes the door 130. The flue 108, an ash pan 140, a room air blower 142, and other components are connected to the main body 150 of the woodstove 100.

In one embodiment, the single burn rate woodstove 100 includes a primary air inlet 105, a secondary air inlet 114, a secondary air channel 103, and a primary air channel 101. The primary air inlet 105 extends through the front 106 of the main body 150 of the woodstove 100 at a top 124 of the main body 150 of the woodstove 100. In one embodiment, the wood stove 100 includes a primary air manifold 110 configured to transfer primary combustion air from the primary air inlet 105 to below the secondary air orifice 116 for introduction into the combustion chamber 112 at the front 106 of the combustion chamber 112. The primary air manifold 110 extends from above the primary air inlet 105 to below a top 180 of the door 130 of the woodstove 100 at the front 106 of the main body 150 of the woodstove 100. In one embodiment, the primary air manifold 110 is attached to the main body 150 of the woodstove 100.

The secondary air inlet 114 extends through the main body 150 of the woodstove 100 at a bottom of the main body 150 of the woodstove 100. The secondary air channel 103 is configured to receive secondary combustion air from the secondary air inlet 114 and conduct the secondary air to a secondary air orifice 116 at a top end of front 106 of a combustion chamber 112 of the woodstove 100. The primary air channel 101 is configured to transfer primary combustion air from the primary air inlet 105 to below the secondary air orifice 116 for introduction into the combustion chamber 112 at the front 106 of the combustion chamber 112.

In one embodiment, the woodstove 100 further includes a secondary air manifold 116 configured to receive the secondary air from the secondary air channel 103 and direct the secondary air from the secondary air channel 103 into the combustion chamber 112 of the woodstove 100. The secondary air manifold 116 extends horizontally across the combustion chamber 112 of the woodstove 100. The secondary air manifold 116 has a plurality of secondary air orifices therein. The secondary air orifice is one of the plurality of secondary air orifices in the secondary air manifold 116 (i.e., secondary air tube). In one embodiment, the plurality of secondary air orifices are configured to direct the secondary air toward a bottom, rear portion 152 of the combustion chamber 112. The secondary air inlet 114 is in a bottom of the main body 150 of the woodstove 100. In one embodiment, at least one secondary air orifice of the plurality of secondary air orifices are configured to direct the secondary air toward the front 106 of the main body 150 of the wood stove 100. In one embodiment, the secondary air channel is a first secondary air channel 160 at a first side of the main body of the woodstove 100 and the woodstove further includes a second secondary air channel 162 and a second side of the woodstove opposite the first side of the woodstove 100. In one embodiment, the secondary air manifold 116 is configured to extend between the first secondary air channel 160 and the second secondary air channel 162.

In one embodiment, the top baffle 118 defines the top of the combustion chamber 112 of the woodstove 100. A front 170 of the top baffle 118 is higher than a rear 172 of the top baffle 118. The top baffle 118 extends laterally across the entire combustion chamber 112. The top baffle 118 extends from the rear 172 of the combustion chamber 112 toward the front 106 of the main body 150 of the woodstove 100 without contacting the front 106 of the main body 150 of the woodstove 100 such that the exhaust gases exit the combustion chamber 112 at the front 170 of the top baffle 118 by rising above the top baffle 118 to the flue 108 of the woodstove 100. In one embodiment, the secondary air manifold 116 (i.e., tube extending between the first secondary air channel 160 and the second secondary air channel 162) is at the front 170 of the top baffle 118, and the secondary air manifold 116 is directly under the top baffle 118.

In one embodiment, the woodstove 100 further includes an exhaust gas baffle 190 above the top baffle 118. The exhaust gas baffle 190 extends downward from a top 124 of the main body 150 of the woodstove 100 to regulate a flow rate of the exhaust gases passing from the front 170 of the top baffle 118 to the flue 108. The exhaust gas baffle 190 reduces the flow rate of the exhaust gases to increase heat transfer from the exhaust gases to the top 124 of the woodstove 100.

Referring to FIGS. 13-18, a second embodiment of the invention uses one manifold 301 to introduce both primary and secondary combustion air to the combustion chamber 112 at different locations in the woodstove firebox (i.e., combustion chamber 112). The primary combustion air enters the firebox (i.e. combustion chamber 112) at the front 106 and bottom 303 of the combustion chamber 112 from the combustion air manifold 301 so that it feeds the initial combustion process of the wood in the combustion chamber 112. This primary combustion air introduction is the lower air introduction point in the firebox. Secondary combustion air is introduced into the combustion chamber 112 (i.e., firebox) at a point above the primary air introduction point where the secondary combustion air mixes with combustion gases (and particulate matter) just before these exhaust gases pass around the 170 front edge of the top baffle 118 and toward the back of the stove 100 to exit the flue 108. The precise metering of air (metering rate driven by firebox size) at the upper and lower introduction points allows for the stove 100 to operate at an optimal firing rate for both particulate matter emissions and efficiency. This also produces a very simple, low maintenance stove 100 in that the minimal parts are added to the stove 100. The combustion air manifold 301 serves to preheat both primary and secondary combustion air while delivering the primary and secondary combustion air from the intake 310 in the door 103 of the stove 100 to the primary air outlet 320 toward the bottom 303 of the stove 100 and the secondary air outlets 330 toward the top 124 of the stove 100. In one embodiment, the primary air outlet 320 is formed by a gap between the door 103 of the stove 100 and a bottom edge 333 of the combustion air manifold 301. In one embodiment, the combustion air manifold 301 has a top 334 that is substantially sealed against the door 103 of the woodstove 100. In one embodiment, the secondary air outlet 330 comprises a horizontal row of holes in a rear vertical face of the combustion air manifold 301. In one embodiment, the secondary air outlet 330 comprises a plurality of horizontal rows of holes, each row having a different hole size. In one embodiment, the primary air inlet 310 is below the secondary air outlet 330.

In one embodiment, a single burn rate 1 stove 100 includes a combustion air inlet 310 and a combustion air manifold 301. The combustion air inlet 310 extends through the door 103 of the woodstove 100.

The combustion air manifold 301 is configured to receive combustion air from the combustion air inlet 310 and provide primary and secondary combustion air to a combustion chamber 112 of the woodstove 100. The combustion air manifold 301 is attached to the door 103 that a back of the door 103. The primary combustion air outlet 320 is formed a bottom 333 of the combustion air manifold 301 such that the primary combustion air outlet 320 provides primary combustion air to the combustion chamber 112 from the combustion air manifold 301. In one embodiment, the primary combustion air outlet 320 is formed between the back of the door 103 and the bottom edge 333 of the combustion air manifold 301 such that a bottom of the combustion air manifold 301 is substantially open. In another embodiment, the primary combustion air outlet 320 is formed by a plurality of holes in the bottom 333 of the combustion air manifold 301.

The secondary combustion air outlet 330 is formed at a of the combustion air manifold 301 such that the secondary combustion air outlet 330 provide second a combustion air to the combustion chamber 112 from the combustion air manifold 301. In one embodiment, the secondary combustion air outlet 330 includes a plurality of holes through a vertical rear surface of the combustion air manifold 301. In one embodiment, the combustion air manifold is sealed to the back of the door 103 at a top 334 of the combustion air manifold 301. In one embodiment, the combustion air manifold is sealed to the back of the door 103 at opposing sides 360 of the combustion air manifold 301.

In one embodiment, the top baffle 118 defines a of the combustion chamber 112. In one embodiment, the top baffle 118 is substantially level when the woodstove 100 is in an upright position.

In one embodiment, the woodstove 100 further includes a window 370 in the door 103. The bottom edge 333 of the combustion air manifold 301 ends at a top edge 372 of the window 370 such that the primary combustion air reduces soot buildup on the window 370. The window 370 may be formed of a substantially transparent material such as tempered glass.

In one embodiment, the combustion air inlet 310 is a row of primary air inlets 390 and a row of secondary air inlets 392. The secondary air inlets 392 are above the primary air inlets 390. The secondary air inlets 392 are smaller than the primary air inlets 390. In one embodiment, the combustion air manifold 301 includes a divider to direct air from the secondary air inlets 392 to the secondary air outlets 330 and from the primary air inlets 392 the primary air outlet 320.

In one embodiment, the wood stove 100 further includes a room air blower 142 configured to receive room air from the room to be heated by the wood stove 100 and move the received room air up a back 402 of the combustion chamber 112 and toward the front 106 of the woodstove 100 having the door 103.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful PLATE STEEL SINGLE BURN RATE WOOD HEATER WITH IMPROVED EMISSIONS it is not intended that such references be construed as limitations upon the scope of this invention except as set forth in the following claims.

What is claimed is:

1. A single burn rate woodstove comprising:

a primary air inlet through a front of a main body of the woodstove at a top of the main body of the woodstove;

a secondary air inlet through the main body of the woodstove;

a secondary air channel configured to receive secondary air from the secondary air inlet and conduct the secondary air to a secondary air orifice at a top and a front of a combustion chamber of the woodstove;

a primary air channel configured to transfer primary combustion air from the primary air inlet to below the secondary air orifice for introduction into the combustion chamber at the front of the combustion chamber;

a top baffle defining a top of the combustion chamber of the woodstove, wherein a front of the top baffle is higher than a rear of the top baffle; and a secondary air manifold configured to receive the secondary air from the secondary air channel and direct the secondary air from the secondary air channel into the combustion chamber of the woodstove, wherein the secondary air manifold extends horizontally across the combustion chamber of the woodstove, said secondary air manifold having a plurality of secondary air orifices therein, and wherein the secondary air orifice is one of the plurality of secondary air orifices, wherein:

the secondary air manifold is at the front of the top baffle; and the secondary air manifold is directly under the top baffle.

2. The single burn rate woodstove of claim 1, wherein:

the secondary air orifice of the plurality of secondary air orifices is configured to direct the secondary air toward a bottom, rear portion of the combustion chamber; and the secondary air inlet is in a bottom of the main body of the woodstove.

3. The single burn rate woodstove of claim 1, wherein:

the secondary air orifice of the plurality of secondary air orifices is configured to direct the secondary air toward a front of the main body of the woodstove.

4. The single burn rate woodstove of claim 1, wherein the secondary air channel is a first secondary air channel at a first side of the main body of the woodstove, and the woodstove further comprises a second secondary air channel at a second side of the woodstove, wherein the second side of the main body of the woodstove is opposite the first side of the woodstove.

5. The single burn rate woodstove of claim 1, wherein the secondary air channel is a first secondary air channel at a first side of the main body of the woodstove, and the woodstove further comprises:

a second secondary air channel at a second side of the woodstove, wherein the second side of the main body of the woodstove is opposite the first side of the woodstove.

6. The single burn rate woodstove of claim 1, wherein:

the top baffle extends laterally across the entire combustion chamber; and the top baffle extends from the rear of the combustion chamber toward the front of the main body of the woodstove without contacting the front of the main body of the woodstove such that exhaust gases exit the combustion chamber at the front of the top baffle by rising above the top baffle to a flue of the woodstove.

7. The single burn rate woodstove of claim 1, further comprising:

a primary air manifold configured to define the primary air channel and transfer primary combustion air from the primary air inlet to below the secondary air orifice for introduction into the combustion chamber at the front of the combustion chamber; wherein:

the primary air manifold extends from above the primary air inlet to below a top of a door of the woodstove at the front of the main body of the woodstove; and the primary air manifold is attached to the main body of the woodstove.

8. The single burn rate woodstove of claim 1, wherein:

the top baffle extends laterally across the entire combustion chamber; and the top baffle extends from the rear of the combustion chamber toward the front of the main body of the woodstove without contacting the front of the main body of the woodstove such that exhaust gases exit the combustion chamber at the front of the top baffle by rising above the top baffle to a flue of the woodstove; and the single burn rate woodstove further comprises an exhaust gas baffle above the top baffle, wherein said exhaust gas baffle extends downward from a top of the main body of the woodstove to regulate a flow rate of the exhaust gases passing from the front of the top baffle to the flue.

9. A single burn rate woodstove comprising:

a combustion air inlet through a door of the woodstove;

a combustion air manifold configured to receive combustion air from the combustion air inlet and provide primary and secondary combustion air to a combustion chamber of the woodstove, wherein:

the combustion air manifold is attached to the door at a back of the door;

a primary combustion air outlet is formed at a bottom of the combustion air manifold such that the primary combustion air outlet provides primary combustion air to the combustion chamber from the combustion air manifold; and a secondary combustion air outlet is formed at a top of the combustion air manifold such that the secondary combustion air outlet provides secondary combustion air to the combustion chamber from the combustion air manifold; and a window in the door, wherein a bottom edge of the combustion air manifold ends at a top edge of the window such that the primary combustion air reduces soot buildup on the window.

10. The single burn rate woodstove of claim 9, wherein the primary combustion air outlet is formed between the back of the door and the bottom edge of the combustion air manifold such that a bottom of the combustion air manifold is substantially open.

11. The single burn rate woodstove of claim 9, wherein the secondary combustion air outlet comprises a plurality of holes through a vertical rear surface of the combustion air manifold.

12. The single burn rate woodstove of claim 9, wherein the combustion air manifold is sealed to the back of the door at a top of the combustion air manifold.

13. The single burn rate woodstove of claim 9, wherein the combustion air manifold is sealed to the back of the door at opposing sides of the combustion air manifold.

14. The single burn rate woodstove of claim 9, further comprising:

a top baffle defining a top of the combustion chamber, wherein the top baffle is substantially level when the woodstove is in an upright position.

15. The single burn rate woodstove of claim 9, wherein the combustion air inlet comprises a row of primary air inlets and a row of secondary air inlets, wherein the secondary air inlets are above the primary air inlets, and the secondary air inlets are smaller than the primary air inlets.

16. The single burn rate woodstove of claim 9, wherein the secondary combustion air outlet comprises a plurality of holes through a vertical rear surface of the combustion air manifold, and wherein the plurality of holes are in a horizontal row.

17. The single burn rate woodstove of claim 9, further comprising:

a room air blower configured to receive room air from a room to be heated by the woodstove and move the received room air up a back of the combustion chamber and toward a front of the woodstove having the door.

18. A single burn rate woodstove comprising:

a combustion air inlet through a door of the woodstove;

a combustion air manifold configured to receive combustion air from the combustion air inlet and provide primary and secondary combustion air to a combustion chamber of the woodstove, wherein:

the combustion air manifold is attached to the door at a back of the door;

a primary combustion air outlet is formed at a bottom of the combustion air manifold such that the primary combustion air outlet provides primary combustion air to the combustion chamber from the combustion air manifold;

a secondary combustion air outlet is formed at a top of the combustion air manifold such that the secondary combustion air outlet provides secondary combustion air to the combustion chamber from the combustion air manifold; and the combustion air inlet comprises a row of primary air inlets and a row of secondary air inlets, wherein the secondary air inlets are above the primary air inlets, and the secondary air inlets are smaller than the primary air inlets.

19. The single burn rate woodstove of claim 18, further comprising:

a window in the door, wherein a bottom edge of the combustion air manifold ends at a top edge of the window such that the primary combustion air reduces soot buildup on the window.

* * * * *